US005454539A

United States Patent [19]

Lafontaine

[11] Patent Number: 5,454,539

[45] Date of Patent: Oct. 3, 1995

[54] PLATE HOLDER DEVICE

[76] Inventor: Doris M. Lafontaine, 42 Fotene St., Nashua, N.H. 03062

[21] Appl. No.: 143,649

[22] Filed: Nov. 1, 1993

[51] Int. Cl.[6] ..... A47G 1/16

[52] U.S. Cl. ..... 248/302; 211/41; 248/488; 248/490; 248/492

[58] Field of Search ..... 248/302, 488, 248/490, 489, 492, 491, 493, 544, 329, 330.1; 211/41, 106

[56] References Cited

U.S. PATENT DOCUMENTS

| | | | |
|---|---|---|---|
| 703,709 | 7/1902 | Olmstead | 248/492 X |
| 897,668 | 9/1908 | Shoemaker | 211/41 X |
| 1,023,072 | 4/1912 | Fleming | 248/490 |
| 1,212,422 | 1/1917 | Thomas | 248/490 |
| 2,315,268 | 3/1943 | Oliphant | 248/490 |
| 2,559,057 | 7/1951 | Williams | 248/490 |
| 4,389,228 | 6/1983 | Leunig | 248/330.1 X |
| 4,601,453 | 7/1986 | Kagan | 248/329 |
| 4,687,169 | 8/1987 | Thomas | 211/41 X |
| 5,152,493 | 10/1992 | Giles | 248/490 |

FOREIGN PATENT DOCUMENTS

| | | | |
|---|---|---|---|
| 69879 | 3/1952 | Netherlands | 248/490 |
| 28200 | 12/1908 | United Kingdom | 248/488 |

*Primary Examiner*—Ramon O. Ramirez
*Assistant Examiner*—Derek J. Berger

[57] ABSTRACT

A holder for a plate designed to be mounted on a vertical wall or other surface having a circular plate-engaging rigid wire ring and a plurality of bendable wire loops spaced about and secured to such wire ring, such wire loops being adapted to be bent over and around the edges of the plate positioned on said ring to secure such plate fixedly against the ring. Also secured to such ring is a hang loop adapted to engage over a projection such as a nail or screw to hang said ring and associated plate on a wall or the like.

2 Claims, 4 Drawing Sheets

PLATE HOLDER DEVICE

BACKGROUND OF THE INVENTION

1. Field of the Invention

The present invention relates to plate holders and more particularly pertains to such a holder device which may be secured to a decorative plate or the like in a positive fashion precluding accidental separation of the plate from the holder and which permits hanging the plate vertically on a wall or the like.

2. Description of the Prior Art

The use of plate holders is known in the prior art. More specifically, holders heretofore devised and utilized for the purpose of holding plates are known to consist basically of familiar, expected and obvious structural configurations, notwithstanding the myriad of designs encompassed by the crowded prior art which have been developed for the fulfillment of countless objectives and requirements. Much of the art is devoted to holding plates at an angle from a flat surface on which the holder is positioned, e.g. U.S. Pat. No. 4,343,450. Other devices for hanging plates on wall surfaces are shown in U.S. Pat. Nos. 4,473,207; 4,364,537; 4,687,169; and 5,152,493. In some of these devices, the hooks engaging with the plate are easily dislodgeable and/or the plate may roll out of engagement with the open type hook supports shown in the event of accidental vibration or disturbance of the plate holder. In others, such as U.S. Pat. Nos. 4,364,537 and 4,473,207, the holders are complex and expensive to produce.

In this respect, the plate holder according to the present invention substantially departs from the conventional concepts and designs of the prior art, and in so doing provides a device primarily developed for the purpose of securely holding the plate to the supporting holder.

Therefore, it can be appreciated that there exists a continuing need for new and improved plate holders which can be inexpensively produced and which will securely hold a plate against separation from the holder. In this regard, the present invention substantially fulfills this need.

SUMMARY OF THE INVENTION

In view of the foregoing disadvantages inherent in the known types of plate holders now present in the prior art, the present invention provides an improved plate holder construction wherein the same can be utilized at modest cost to securely hold a decorative plate on a vertical wall. As such, the general purpose of the present invention, which will be described subsequently in greater detail, is to provide a new and improved plate holder which has all the advantages of the prior art devices and none of the disadvantages.

To attain this, the present invention essentially comprises a holder for a plate designed to be mounted on a vertical wall or other surface having a circular plate-engaging rigid wire ring and a plurality of bendable wire loops spaced about and secured to such wire ring, such wire loops being adapted to be bent over and around the edges of the plate positioned on said ring to secure such plate fixedly against the ring. Also secured to such ring is a hang loop adapted to engage over a projection such as a nail or screw to hang said ring and associated plate on a wall or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved plate holder device which has all the advantages of the prior art devices and none of the disadvantages.

It is another object of the present invention to provide a new and improved plate holder device which may be easily and efficiently manufactured and marketed.

It is a further object of the present invention to provide a new and improved plate holder device which is of a durable and reliable construction.

An even further object of the present invention is to provide a new and improved plate holder device which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved plate holder device which provides in the apparatuses of the prior art some of the advantages thereof, while simultaneously overcoming some of the disadvantages normally associated therewith.

Still another object of the present invention is to provide a new and improved plate holder device which securely holds a plate thereon against accidental dislodgement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
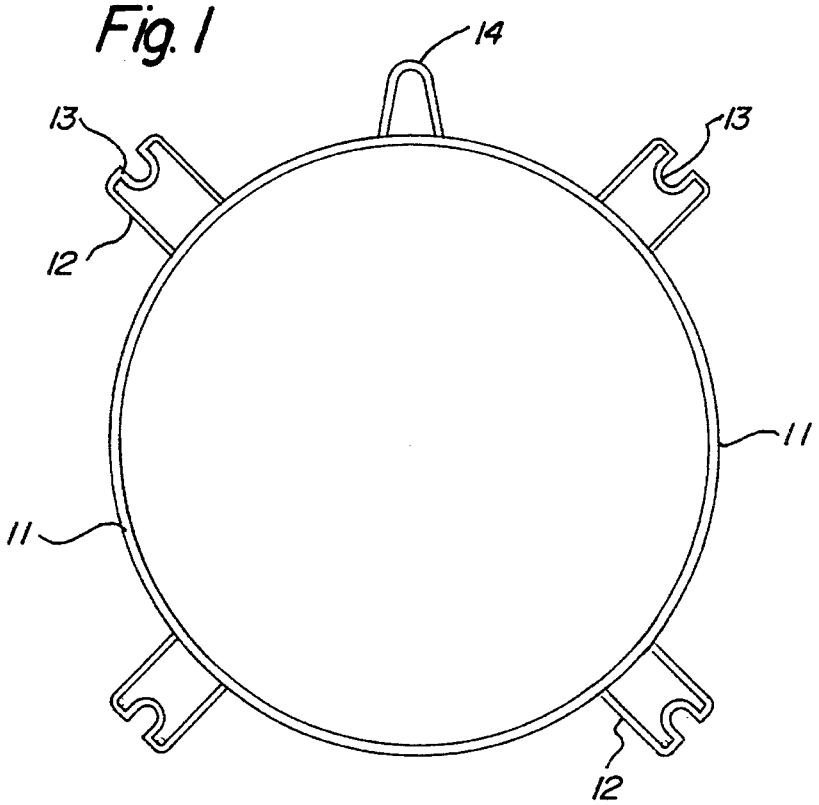
FIG. 1 is a front elevation view of the device of the present invention.
Figure 2:
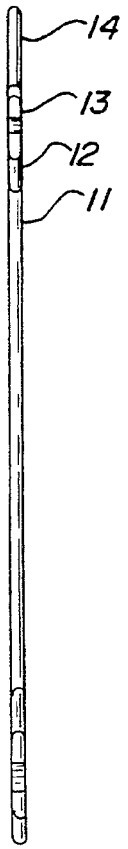
FIG. 2 is a side elevation view of the device of FIG. 1.

With reference now to the drawings, and in particular to FIGS. 1 and 2 thereof, a new and improved plate holder device embodying the principles and concepts of the present invention and generally designated by the reference numeral 10 will be described.

More specifically, it will be noted that the device 10 comprises a circular wire ring member 11 which may be made in a variety of diameters dependant upon the diameter of the plate to be supported thereon. As shown in subsequent drawings, the ring member 11 is of slightly smaller diameter than the plate with which it is to used. Spaced about the periphery of ring member 11 and affixed thereto by soldering is a plurality (at least four) of bendable wire clip members 12. Such clip members 12 are formed of smaller diameter wire than that of ring member 11 and preferably have a U-shaped bend 13 at the outer extremity of each clip 12 to provide a finger-engaging recess. Also affixed by soldering to ring member 11 at a point on such ring intermediate two of clips 12 is a hanger member 14. The position of hanger member 14 determines the top point of said device 10 when the unit is hung on a vertical surface.

Figure 3:
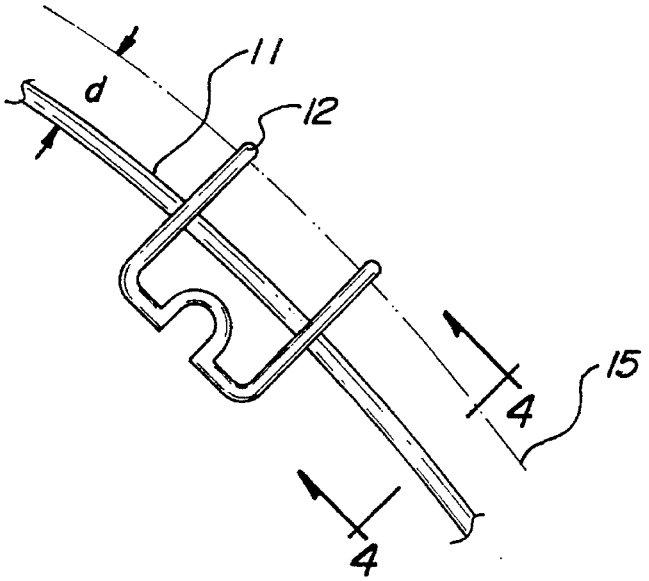
FIG. 3 is a partial end view of the device of FIG. 1 showing one of the clips thereof bent around a plate mounted on the device.
Figure 4:
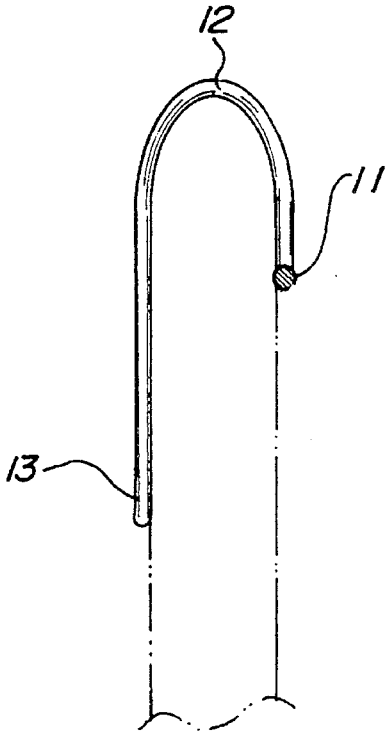
FIG. 4 is a side view of the clip shown in FIG. 3.

FIG. 3 illustrates the bending of one of the clip members 12 so as to secure a plate against the ring member 11. The plate 15 is shown in broken lines only so as not to obscure ring member 11. Plate 15, in use, is positioned against ring member 11 and clip member 12 is bent thereover so that the finger-engaging recess or U-shaped bend 13 extends down onto the face of such plate 15. As illustrated, the plate 15 is of larger diameter than ring member 11 allowing the plate 15 to extend a distance "d" beyond such ring member 11. When clip member 12 is bent as described herein, the engagement with plate 15 is very positive, particularly as there are at least four of such clips disposed around ring 11, and dislodgement of such plate from the clips will require a physical unbending of clips 12 as clearly shown in FIG. 4.

Figure 5:
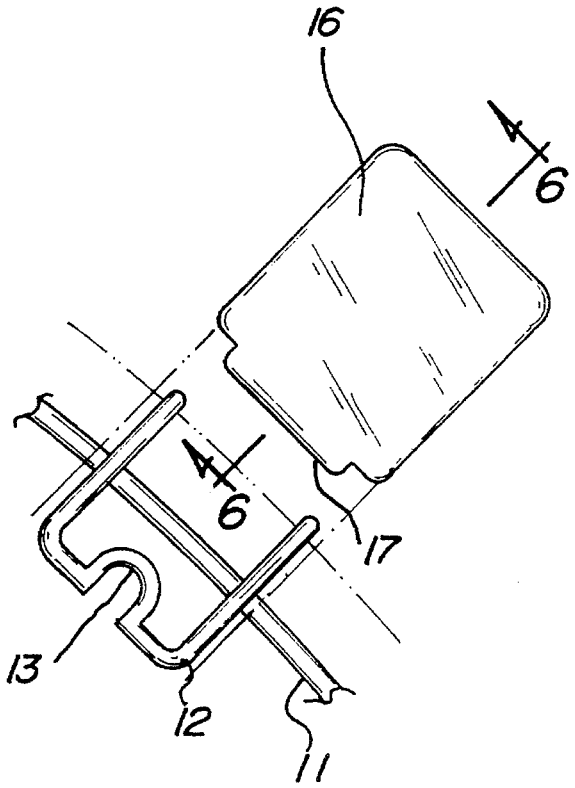
FIG. 5 is the same as FIG. 3 with an exploded view of a retaining sleeve designed to slide over the clip.
Figure 6:
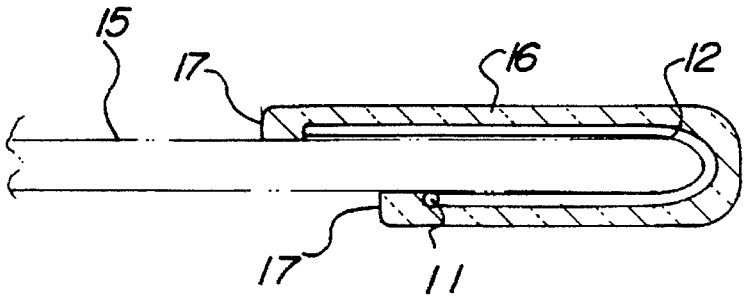
FIG. 6 is a sectional view on line 6—6 of FIG. 5.

FIGS. 5 and 6 illustrate the addition of a positive restraint against unbending of clip 12 comprising a plastic sleeve 16 open at one end 17 thereof to allow such sleeve 16 to slide downwardly over the bent clip 12 and the enclosed plate 15 and to effectively prevent unbending of such clip without removal of the sleeve 16.

Figure 7:
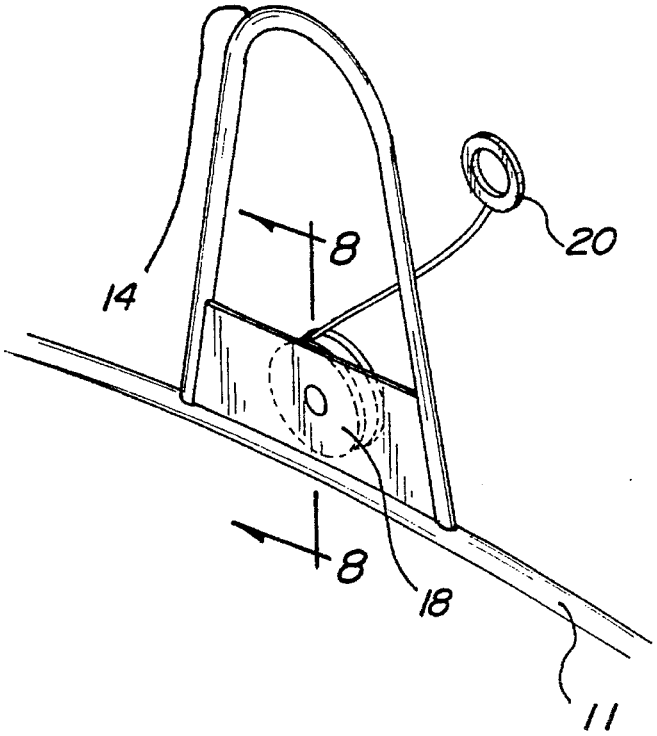
FIG. 7 is a perspective view of the device of FIG. 1 showing a modification of the hanger thereon.
Figure 8:
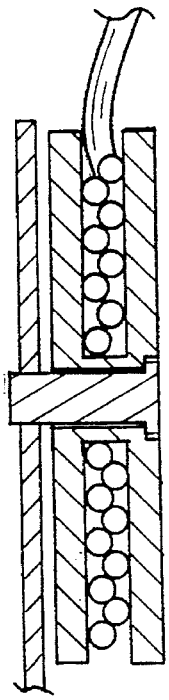
FIG. 8 is a sectional view taken on line 8—8 of FIG. 7.

FIGS. 7 and 8 illustrate a safety modification for hanger 14. Since plate 15 is secured firmly against accidental dislodgement from the holder device 10 as described above, the only real danger of damage to such plate comes from possible knocking of the device 10 off the nail or other projection on which hanger 14 is positioned. A safety chain or wire could be attached by loosely stringing it from the hanger 14 to its hanging nail but would generally be unsightly unless it was very short in which case the probability of the force dislodging the hanger would be transmitted by such short safety chain to the supporting nail or screw and cause it to be pulled from the wall as well. Additionally, a very short safety chain would be physically difficult to position when hanging the device 10. However, by modifying hanger 14 to support a small diameter cable holding spool 18, a substantial length of cable 19 can be rolled thereon, such cable being affixed at one end to spool 18 and having at its other end an eye hook 20 adapted to slip over the support nail for device 10 before the hanger 14 is placed thereon. In case the device 10 is knocked off the support nail, cable 19 will unwind and prevent device 10 from hitting the floor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plate holder device for mounting on a vertical surface and for receiving a plate, wherein the device comprises: a circular wire rigid ring having a plurality of bendable wire loops secured to and spaced around said rigid wire ring, each of said wire loops having a distal end spaced from the rigid ring, said bendable wire loops extending exteriorly of said ring and bendable inwardly for engagement of the plate; and hanger means affixed to said rigid ring between two of said plurality of wire loops; each of said loops including a U-shaped recess for finger engagement in the distal end thereof;

the device comprises: a circular wire rigid ring having a plurality of bendable wire loops secured to and spaced around said rigid wire ring, each of said wire loops having a distal end spaced from the rigid ring, said bendable wire loops extending exteriorly of said ring and bendable inwardly for engagement of the plate; and hanger means affixed to said rigid ring between two of said plurality of wire loops; each loop having a plastic clip, whereby said plastic clips are positioned over said wire loops after they have been bent inwardly to prevent such loops from accidentally being unbent.

2. A plate holder device for mounting on a vertical surface and for receiving a plate, wherein the device comprises: a circular wire rigid ring having a plurality of bendable wire loops secured to and spaced around said rigid wire ring, each of said wire loops having a distal end spaced from the rigid ring, said bendable wire loops extending exteriorly of said ring and bendable inwardly for engagement of the plate; and hanger means affixed to said rigid ring between two of said plurality of wire loops; said hanger having a spool, said spool rotatably mounted adjacent to the hanger and said spool containing a safety cable, said cable being affixed at one end to said spool and an eye hook attached to the other end of said cable.

* * * * *